US006350157B1

(12) United States Patent
Mizusawa

(10) Patent No.: US 6,350,157 B1
(45) Date of Patent: Feb. 26, 2002

(54) CONNECTOR WITH MALFITTING PREVENTION DEVICE

(75) Inventor: Shuji Mizusawa, Machida (JP)

(73) Assignee: I-Pex Co., LTD, Machida (JP)

( * ) Notice: Subject to any disclaimer, the term of this patent is extended or adjusted under 35 U.S.C. 154(b) by 0 days.

(21) Appl. No.: 09/631,047

(22) Filed: Aug. 1, 2000

(30) Foreign Application Priority Data

Mar. 17, 2000 (JP) ..... 2000-076011

(51) Int. Cl.[7] ..... H01R 24/00
(52) U.S. Cl. ..... 439/676; 439/677
(58) Field of Search ..... 439/676, 677, 439/218, 680, 344

(56) References Cited

U.S. PATENT DOCUMENTS

| | | | | |
|---|---|---|---|---|
| 4,764,129 A | | 8/1988 | Jones et al. | 439/677 |
| 6,186,835 B1 | * | 6/1999 | Cheshire | 439/676 |
| 6,086,430 A | | 7/2000 | Amoni et al. | 439/680 |

* cited by examiner

*Primary Examiner*—Neil Abrams
*Assistant Examiner*—Javaid Nasri

(57) ABSTRACT

A communication cable connector (1) is provided with a malfitting prevention member (10) that allows an associated communication cable plug (21) to be fitted into the communication cable connector (1) while preventing insertion of an unassociated communication cable plug (30) thereinto.

1 Claim, 6 Drawing Sheets

CONNECTOR WITH MALFITTING PREVENTION DEVICE

BACKGROUND OF THE INVENTION

1. Field of the Invention

The present invention relates to an improvement of a communication cable connector to which a communication cable plug is fit.

2. Description of the Related Art

With recent electronic devices such as personal computers, internet communication which transmits data via a telephone line is frequently carried out. For the internet communication, a modem is usually built in the personal computer. Further, a modem connector (a so-called modular jack) as a communication cable connector, is provided at the body of the computer, through which the modem and a telephone line are connected.

Recently, in addition to the internet communication that is conducted via a telephone line, a local area network (LAN) is constructed among a plurality of the personal computers in which the computers are mutually connected by a data communication network. To construct LAN, a network interface card (NIC) is built in each personal computer. Further, a connector for the communication cable (a so-called Ethernet cable), that is, a LAN connector is provided at the body of the computer. Through the LAN connectors, NICs built in each computer are connected to each other.

The LAN connector is different from the modem connector. Generally, the standard RJ-45 is used for the LAN connector while the standard RJ-11 is used for the modem connector.

In most of the personal computers that are recently manufactured, both the LAN connector and modem connector are installed at the body thereof. Thus, there sometimes occurs a case in which a user mistakenly connects a modem plug to the LAN connector instead of connecting the modem connector. Such connection error of a plug to wrong (unassociated) connector causes a malfunction in the personal computer.

SUMMARY OF THE INVENTION

With the foregoing in view, it is an object of the present invention to provide a communication cable connector that cannot fit with unassociated plugs.

To achieve the above object, according to the present invention, a communication cable is provided with a malfitting prevention means that permits fitting of an associated communication cable plug, but prevents insertion of communication cable plugs which are not associated with the connector.

DESCRIPTION OF THE PREFERRED EMBODIMENTS

An embodiment of a communication cable connector according to the present invention will be described hereunder in detail.

Figure 1:
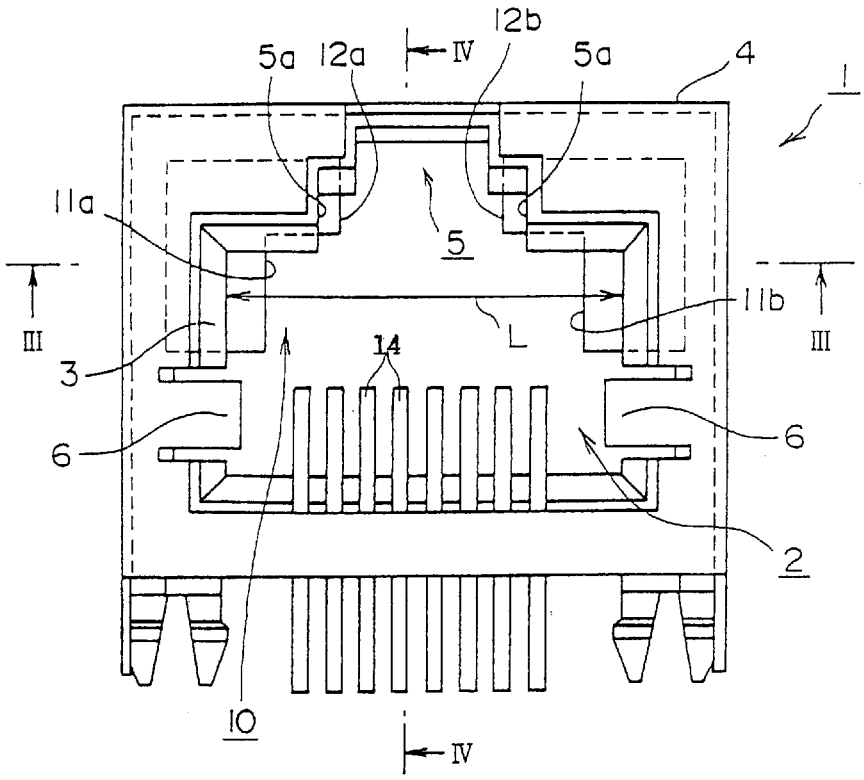
FIG. 1 is an enlarged front view of a communication cable connector according to the present invention.

FIG. 1 is a front view of a communication cable connector 1 according to the present invention, particularly showing a LAN connector to which an Ethernet cable, that is, a LAN plug is fit and supported.

The communication cable connector 1 comprises an insulator 3 and a metal shield 4 covering the insulator 3 from outside. In the insulator 3, a plug hole 2 into which a LAN plug, which will be described later, is fit is formed At the bottom of the plug hole 2 and in the width direction of the plug hole 2, eight contacts 14 to be pressure contact with the contact of the LAN plug, which will be described later, are provided in parallel at a predetermined pitch.

On the top of the hole 2, a guide groove 5 having a step-shaped section for securing the LAN plug in the hole 2 is formed along the depth direction thereof (the direction perpendicular to the face of the drawing). On the lowest step of the guide groove 5, a latch pawl fitting groove 5a is formed. The latch pawl fitting groove 5a guides a latch pawl of latch means arranged in the LAN plug, which will be described later.

In FIG. 1, reference numeral 6 indicates a shielding tongue piece which is formed integrally with the shield 4 and extended inward the plug hole 2 from the surface thereof. When a LAN plug, not shown in the drawing, is fit into the plug hole 2, the tongue piece 6 is in pressure contact with a shielding member arranged on the surface of the LAN plug, whereby the shielding member of the LAN plug and the shield 4 are electrically connected to each other.

In the insulator 3, malfitting prevention means 10 is arranged. The malfitting prevention means 10 prevents a plug having a width narrower than the width L of the plug hole 2 from fitting into the plug hole 2.

Figure 3:
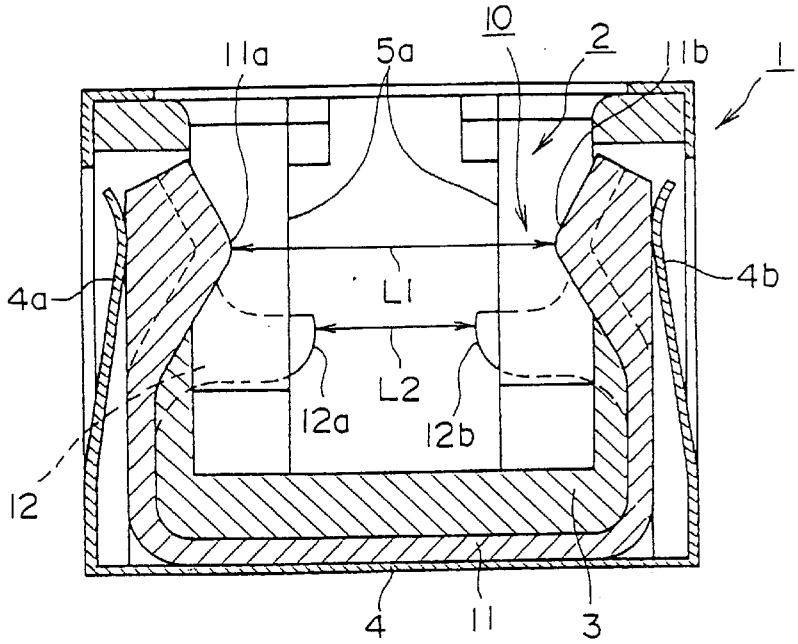
FIG. 3 is a III—III schematic cross sectional view the communication cable connector shown in of FIG. 1.
Figure 5:
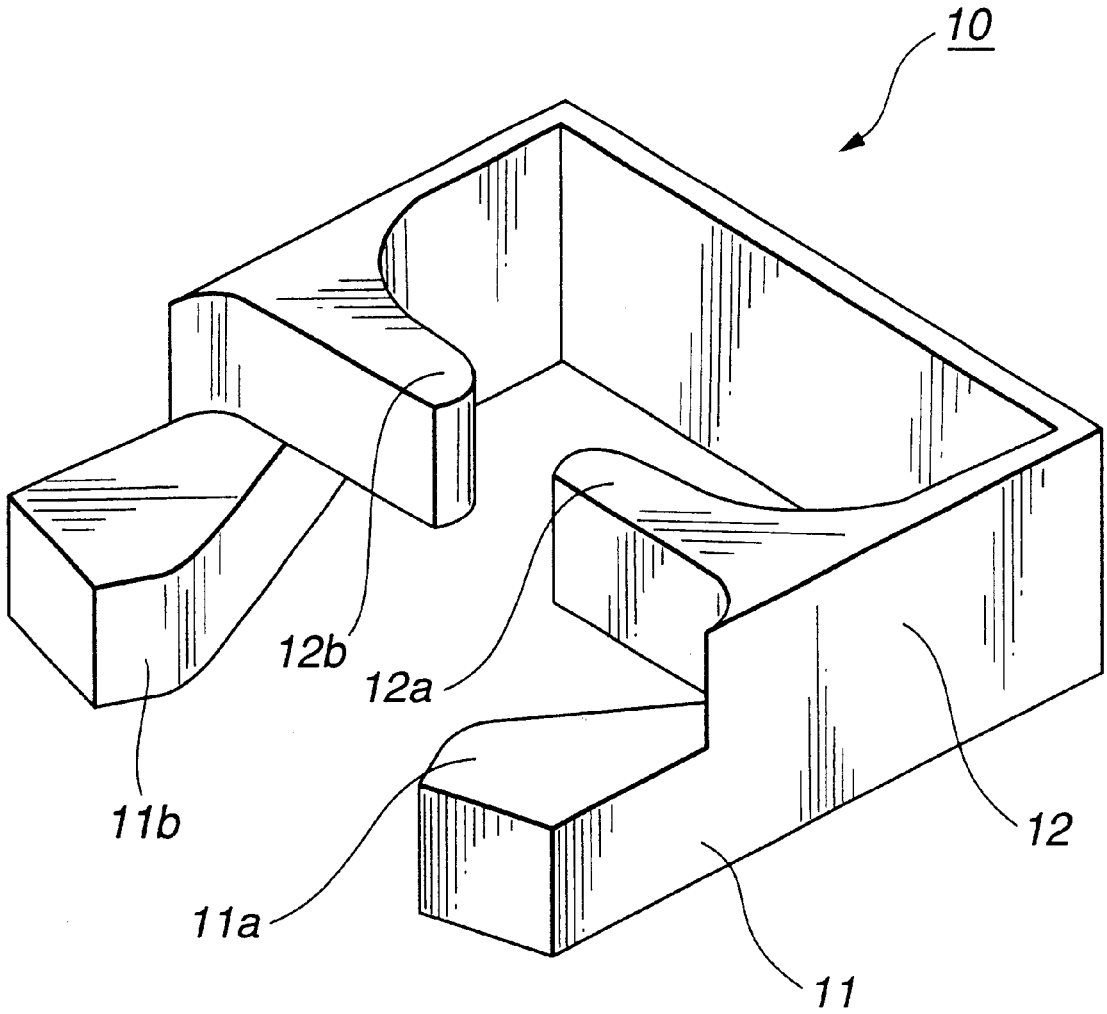
FIG. 5 is an enlarged perspective view of a malfitting prevention means.

Referring to FIG. 3 showing the III—III cross sectional view of the connector 1 in FIG. 1 and to FIG. 5 showing its enlarged perspective view, the malfitting prevention means 10 is constituted by a plug guide pawl 11 and a plug insertion restricting pawl 12. The plug guide pawl 11 has a substantially U-shaped section with both ends 11*a* and 11*b* thereof being projected into the plug hole 2. The plug insertion restricting pawl 12 is integrally formed with the plug guide pawl 11 and has a substantially U-shaped section with both ends 12*a* and 12*b* thereof being projected into the latch pawl insertion groove 5*a*.

As shown in FIG. 3, the plug guide pawl 11 is designed so that both ends 11*a* and 11*b* thereof are pressed by the pressing force of a pair of elastic tongue pieces 4*a* and 4*b* formed on both sides of the shield 4 and a width L1 between both ends 11*a* and 11*b* thereof is narrowed.

Since the plug insertion restricting pawl 12 is formed integrally with the plug guide pawl 11, a width L2 between both ends 12*a* and 12*b* thereof changes as a width L1 between both ends 11*a* and 11*b* of the plug guide pawl 11 changes. Namely, when the width L1 of the plug guide pawl 11 is widened, the width L2 of the plug insertion restricting pawl 12 is also widened, and when the width L1 of the plug guide pawl 11 is narrowed, the width L2 of the plug insertion restricting pawl 12 is also narrowed.

Figure 2:
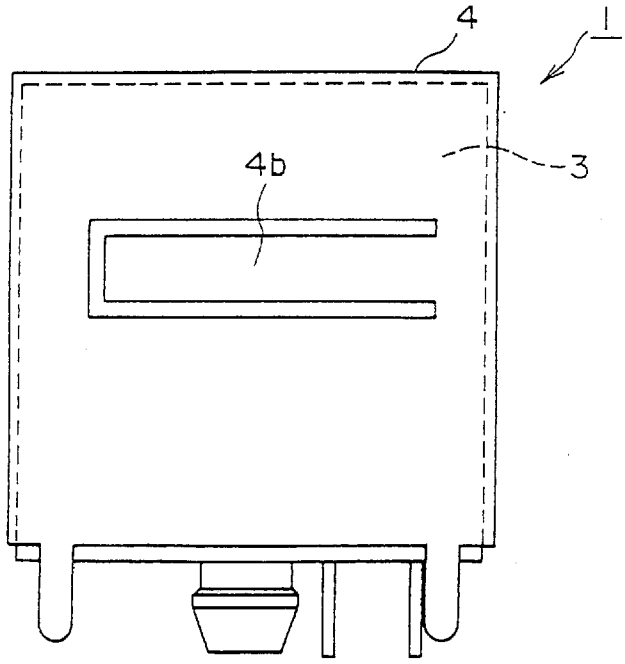
FIG. 2 is a side view of the communication cable connector shown in FIG. 1.
Figure 4:
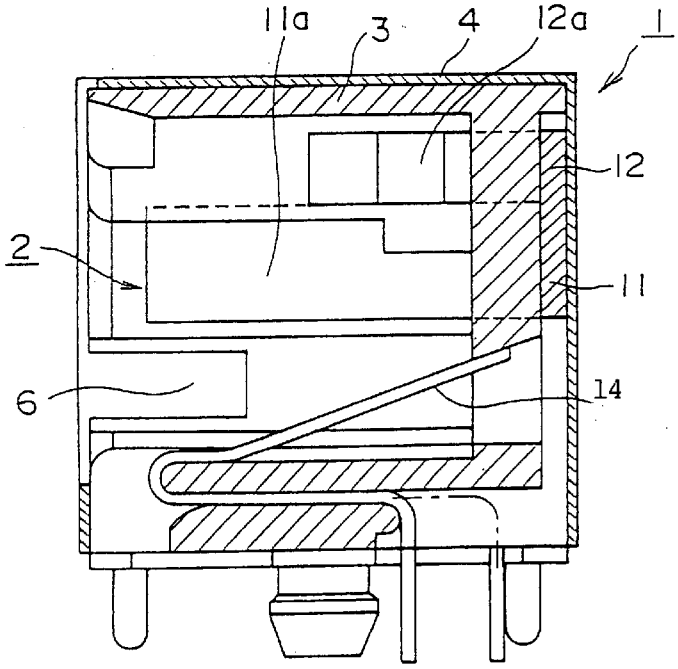
FIG. 4 is a IV—IV schematic cross sectional view of the communication cable connector shown in FIG. 1.

FIG. 2 is a right side view of the communication cable connector 1 in FIG. 1 and FIG. 4 is a IV—IV cross sectional view of the communication cable connector 1 in FIG. 1.

Next, the operation of the communication cable connector 1 will be explained, and also the constitution thereof will be explained in detail.

Figure 6:
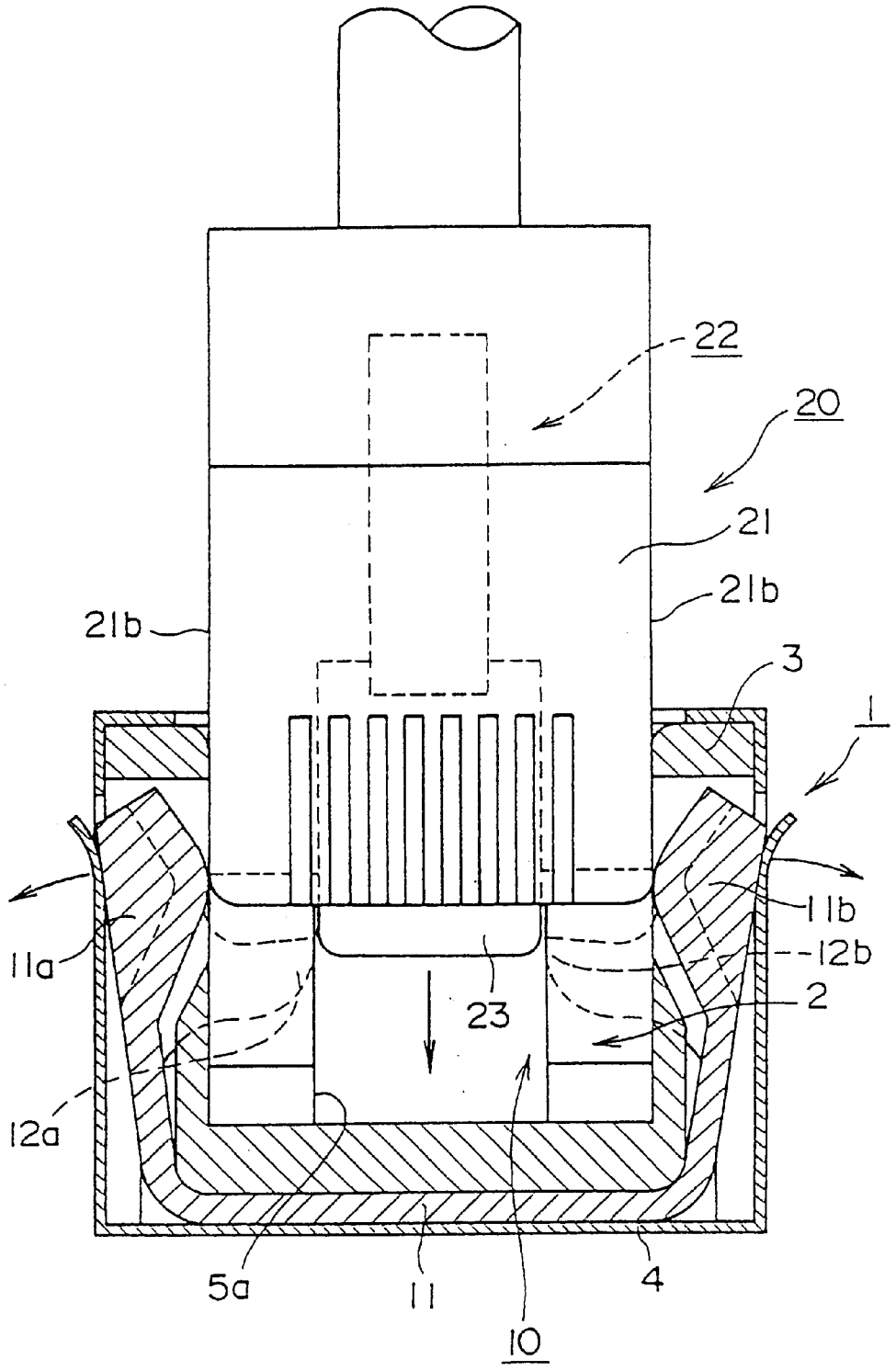
FIG. 6 is a schematic cross sectional view showing the operation of the communication cable connector according to the present invention.

Referring to FIG. 6 in which the same numerals are assigned to the same parts as those shown in FIG. 3, when a LAN plug 20 is fit into the plug hole 2 of the communication cable connector 1, firstly both sides 21*a* and 21*b* of a body 21 of the LAN plug 20 slide while being in contact with both ends 11*a* and 11*b* of the plug guide pawl 11 constituting the malfitting prevention means 10. This action widens the space between both the ends 11*a* and 11*b*of the plug guide pawl 11 by a pushing force by the sides 21*a* and 21*b* of a body 21 of the LAN plug 20, and at the same time, a latch pawl 23 constituting a latch means 22 of the LAN plug 20 enters the latch pawl fitting groove 5*a* which is an insertion path of the latch pawl 23.

Then, in accordance with spreading of the space between both ends 11*a* and 11*b* of the plug guide pawl 11 by both sides 21*a* and 21*b* of the body of the LAN plug 20, the width between both ends 12*a* and 12*b* of the plug insertion restricting pawl 12 is also spread, whereby both ends 12*a* and 12*b* of the plug insertion restricting pawl 12, as shown in the drawing, withdraw from inside the latch pawl fitting groove 5*a* for guiding the latch pawl 23.

Figure 7:
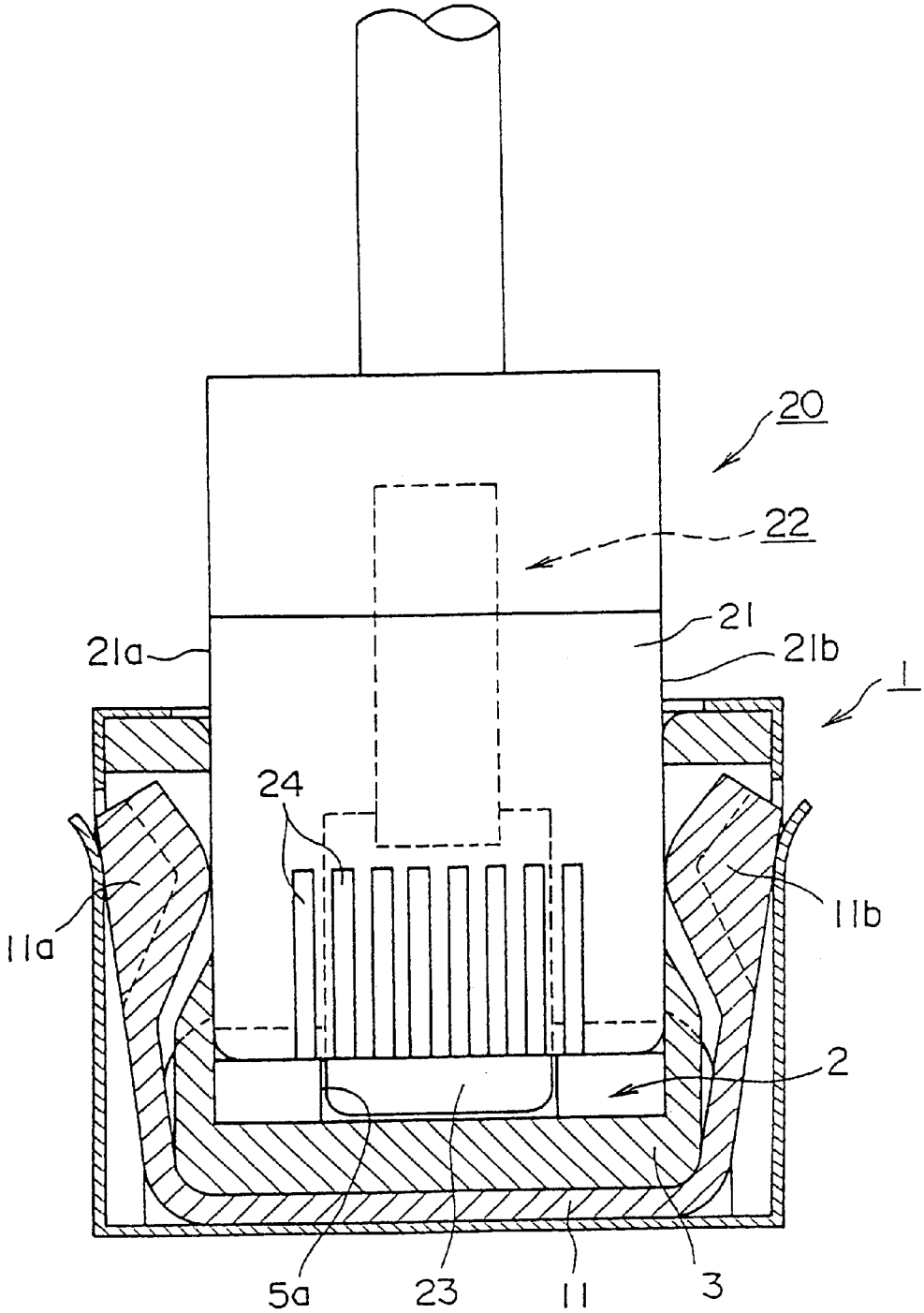
FIG. 7 is a schematic cross sectional view showing the operation of the communication cable connector according to the present invention.

As a result, the LAN plug 20, as shown in FIG. 7, is smoothly fit into the plug hole 2 of the communication cable connector 1. Thereafter, the latch pawl 23 constituting the latch means 22 of the LAN plug 20 is connected to the insulator 3 of the communication cable connector 1 and positioned and supported at the appropriate position of the insulator 3, and at the same time, each contact 24 of the LAN plug 20 is connected to each associated contact 4 (FIG. 1) of the communication cable connector 1.

Therefore, according to the communication cable connector 1, since the communication cable connector 1 is a LAN connector in this case, the LAN plug 20, which is an associated plug for the LAN connector, is smoothly fit into the communication cable connector 1.

Now, a case in which an unassociated plug, that is, a modem plug 30 is fit into the LAN connector, which is the communication cable connector 1, will be described in detail by referring to FIG. 8.

Figure 8:
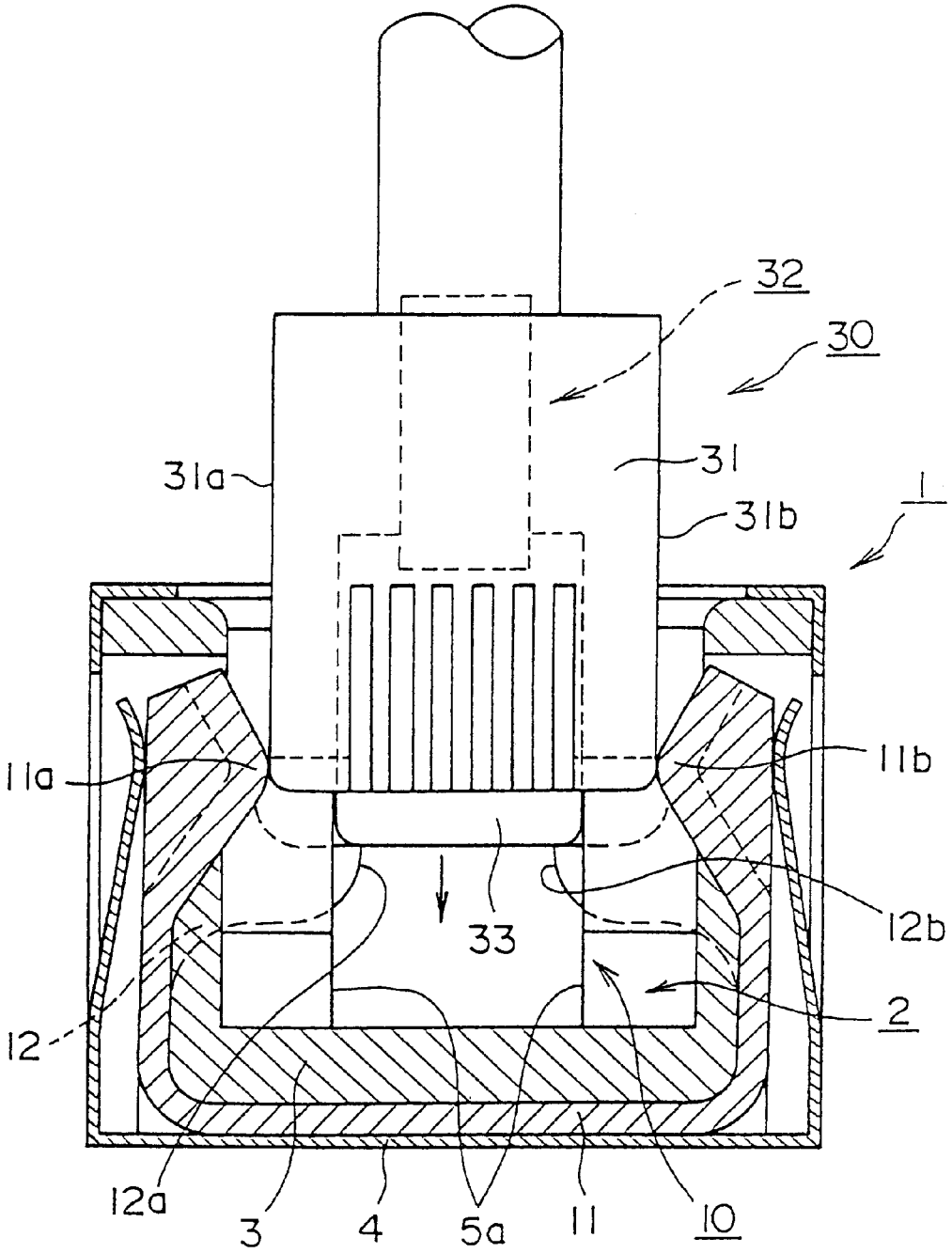
FIG. 8 is a schematic cross sectional view showing the operation of the communication cable connector according to the present invention.

As shown in FIG. 8, the width between both sides 31*a* and 31*b* of a plug body 31 constituting the modem plug 30 is structured to be narrower than the width of both sides 21*a* and 21*b* of the LAN plug body 21 shown in FIG. 6.

Referring to FIG. 8, when the modem plug 30 is fit into the plug hole 2 of the communication cable connector 1, both sides 31*a* and 31*b* of the plug body 31 constituting the modem plug 30 pass through both ends 11*a* and 11*b* of the plug guide pawl 11 constituting the malfitting prevention means 10 without sliding in contact with the ends 11*a* and 11*b*. At the same time, the latch pawl 33 constituting the latch means 32 of the modem plug 30 enters the latch pawl fitting groove 5*a*.

In this case, the space between both ends 11*a* and 11*b* of the plug guide pawl 11 is not spread by both sides 31*a* and 31*b* of the body of the modem plug 30, so that the space between both ends 12*a* and 12*b* of the plug insertion restricting pawl 12 is not spread either. As a result, both ends 12*a* and 12*b* of the plug insertion restricting pawl 12, as shown in the drawing, are kept in the state that the ends are still inserted in the latch pawl fitting groove 5*a* which is an insertion path for guiding the latch pawl 23.

When both ends 12*a* and 12*b* of the plug insertion restricting pawl 12 are kept in the state that they are still inserted in the latch pawl fitting groove 5*a*, the latch pawl 33 of the modem plug 30 collides with both ends 12*a* and 12*b* of the plug insertion restricting pawl 12 as shown in FIG. 8. Therefore, the latch pawl 33 is prevented from subsequent insertion, and stopped at that position.

Therefore, according to the communication cable connector 1, which is a LAN connector, when an unassociated plug, that is, the modem plug 30, which is not for the LAN connector, is inserted, this insertion is prevented by both ends 12*a* and 12*b* of the plug insertion restricting pawl 12.

The aforementioned embodiment described the case in which the malfitting prevention means 10 is applied to a LAN connector. However, the present invention is not limited to this embodiment. The malfitting prevention means of the present invention may be applied to a modem connector, or to any type of connector as far as the connector is a communication cable connector.

As explained above, in a communication cable connector according to the present invention, when an unassociated communication cable plug is fit into the communication cable connector, a malfitting prevention means for preventing the insertion is arranged in the connector, so that a unassociated communication cable plug can be prevented from fitting as much as possible, thereby malfunctions of an information processing unit such as a personal computer to which communication cable connectors are mounted can be prevented as much as possible.

The present invention can be effected in various types of embodiments without being deviated from the spirit or main characteristics thereof. The aforementioned embodiment is just an example in every respect and must not be interpreted limitatively. The scope of the present invention is indicated by the claims of this application but not restricted by the text of the specification. Any modification and changes made within the equivalence in the scope of the claims fall within the scope of the present invention.

What is claimed is:

1. A communication cable connector into which a communication cable plug is fit, wherein a communication cable plug associated with the communication cable connector has a predetermined width corresponding to a width of the communication cable connector, and a communication cable plug not associated with the communication cable connector has a width smaller than the predetermined width, both the communication cable plugs associated and not associated with the communication cable connector being allowed to be inserted into the communication cable connector, comprising:

malfitting prevention means provided inside the communication cable connector, for permitting the communication cable plug associated with the communication cable connector to be fitted into the communication cable connector when inserted into the communication cable connector, and for preventing the communication cable plug not associated with the communication cable connector from being connected to the communication cable connector when inserted into the communication cable connector, wherein the malfitting prevention means comprise:

a plug guide pawl which slides while being in contact with outside of a communication cable plug being fit thereinto so that a space between both ends thereof is widened; and a plug insertion restricting pawl formed integrally with the plug guide pawl, which normally extends into an insertion path of the communication cable plug so as to prevent insertion of the communication cable plug, and spreads the space between ends thereof as the space between the ends of the plug guide pawl is spread so as to spread the insertion path of the communication cable plug.

* * * * *